US006513293B2

(12) United States Patent
Miller

(10) Patent No.: US 6,513,293 B2
(45) Date of Patent: Feb. 4, 2003

(54) INSULATED CEMENTACEOUS BUILDING BLOCK

(76) Inventor: Dennis Miller, 12367 N. 120th Pl., Scottsdale, AZ (US) 85259

( * ) Notice: Subject to any disclaimer, the term of this patent is extended or adjusted under 35 U.S.C. 154(b) by 0 days.

(21) Appl. No.: 09/866,024

(22) Filed: May 24, 2001

(65) Prior Publication Data

US 2001/0022057 A1 Sep. 20, 2001

Related U.S. Application Data

(63) Continuation of application No. 09/274,540, filed on Mar. 23, 1999, now abandoned.

(51) Int. Cl.[7] ..... E04C 1/40

(52) U.S. Cl. ..... 52/405.1; 52/405.4; 52/309.12; 52/606; 52/503; 52/592.6

(58) Field of Search ..... 52/405.1, 405.2, 52/405.4, 404.3, 576, 596, 606, 607, 309.2, 309.11, 309.12, 794.1, 503, 505, 592.6, 592.5

(56) References Cited

U.S. PATENT DOCUMENTS 3,204,381 A * 9/1965 Perreton ..... 52/405.4
4,123,881 A * 11/1978 Muse ..... 52/405.2 X
4,193,241 A * 3/1980 Jensen et al. ..... 52/405.4
4,348,845 A * 9/1982 Iannarelli ..... 52/405.4
4,380,887 A * 4/1983 Lee ..... 52/505 X
4,614,071 A * 9/1986 Sams et al. ..... 52/309.12
4,748,782 A * 6/1988 Johnson et al. ..... 52/405.4
4,769,964 A * 9/1988 Johnson et al. ..... 52/405.4
4,856,249 A * 8/1989 Nickerson ..... 52/405.4
5,402,609 A * 4/1995 Kelley, Jr. ..... 52/604 X
5,421,135 A * 6/1995 Stevens et al. ..... 52/604
5,787,670 A * 8/1998 Muncy ..... 52/607

* cited by examiner

*Primary Examiner*—Carl D. Friedman
*Assistant Examiner*—Winnie Yip

(57) ABSTRACT

A building block for constructing masonry block walls includes a concrete block formed with first, second and third spaced parallel rectangular side walls, where the second side wall is intermediate the first and third side walls. First and second vertical end cross webs connect the first and second side walls; and a notch is formed in the upper surface of each of these vertical end cross webs. First and second spaced intermediate vertical cross webs are located in planes between the planes of the end cross webs and connect the second and third side walls. These intermediate cross webs each also have a notch extending downwardly from the top thereof. A first insulating core is dimensioned to fill the space between the first and second side walls and first and second end cross webs. Ears or protrusions extend outwardly from the insulating core to fit into the notches in the end cross webs. A second insulating core is dimensioned to fit into the space between the second and third side walls and the first and second intermediate cross webs. The second core has protrusions extending outwardly from the upper edge thereof to extend part way into the notches formed in the intermediate cross webs. Mortar relief grooves or notches are formed in the insulating cores to permit their insertion into the block after it has been laid in a course with mortar, such that the cores are non-mortar interfering.

21 Claims, 4 Drawing Sheets

INSULATED CEMENTACEOUS BUILDING BLOCK

This is a continuation, of application Ser. No. 09/274,540, filed Mar. 23, 1999 now abandoned.

BACKGROUND

Building blocks made of concrete or cementaceous material are widely used for building structures. Typically, these blocks are laid in running courses with horizontal and vertical mortar joints, known as butt joints and head joints, to construct a wall. The mortar bonds the block material together to form the completed wall construction. Conventional cement block wall construction employs blocks which are closed at the ends by cross webs, and which typically include a single cross web substantially at the midpoint of the block. The open spaces between the cross webs are used to provide air spaces for insulation purposes and to reduce the weight of the block. These open spaces also are used to accommodate reinforcing bar placement and grout cells for providing a structurally reinforced wall.

Efforts have been made to improve the insulation qualities of concrete block walls by filling the voids between the supporting cross webs with molded insulating material during manufacture of the block. When such cells are prefilled, however, and the block is stored in an outdoor storage yard pending shipment, the insulating material frequently deteriorates in reaction to ultraviolet rays and the like. In addition, when the hollow cells in a masonry block are pre-filled at manufacture, the block is difficult to handle, because of an inadequate means of picking up the block. The foam fills the cores preventing a mason from efficiently grasping the central web or the end web of the block and placing it, a process that is repeated for each and every block during construction. Masons generally prefer a block which can be handled with one hand; so that the other hand can be free to hold a trowel, some other tool, or carry another block.

Composite insulated building block structures have been devised for two-stage construction. First, the blocks are laid using conventional block and mortar structure, but where the blocks have some open overlapping cells. Then a second step involves the subsequent insertion of insulating cores into the voids between the cross webs of the block. The U.S. patent to Perreton U.S. Pat. No. 3,204,381 discloses such a structure. The insulation inserts of Perreton, however, are designed to extend above the upper surface of the blocks for the purpose of establishing a mortar space between adjacent courses. Also, there is no provision for accommodating mortar weepage, which occurs during the construction of a wall using the blocks. As a result, insertion of the insulation inserts may damage or destroy the integrity of the mortar, resulting in an unacceptable construction.

Another patent using insulation inserts in an otherwise conventional block structure is the U.S. patent to Jensen U.S. Pat. No. 4,193,241. Inserts in the Jensen system are placed in the hollow spaces between the webs of the block. These inserts are designed to extend above the upper surface of the block for the purpose of establishing a mortar space between adjacent courses. A problem which exists in both the Perreton and Jensen patents, using inserts which extend above the upper surface of the block itself, is that the inserts interfere with the application of and adjustability of the mortar joint between adjacent courses of blocks. They also require the mason to employ techniques in applying the mortar which differ from those which normally are used with standard concrete blocks not employing such inserts.

The U.S. patent to Johnson U.S. Pat. No. 4,748,782 discloses a variation of the Perreton block which employs overlapping open cells designed for use with insulating foam inserts to provide a self-aligning, self-leveling drystacking (without mortar) construction. Since no mortar is employed in the block configurations of a wall built in conjunction with the blocks of the Johnson patent No. U.S. Pat. No. 4,748,782, uniform and accurate block sizing is critically important. Concrete masonry blocks currently are manufactured almost exclusively by automated heavy equipment, which rapidly produces the blocks. Because the concrete and aggregate employed in molding such blocks are highly abrasive, the precisely engineered, high stress metal molds rapidly wear. This causes the dimension of the block produced by the molds to vary as the mold ages. The blocks grow in length and thickness; and the core cells increase in size. As a result, the maintenance of a constant height becomes increasingly more difficult the longer the mold is employed in manufacturing.

In the drystack block configuration of the Johnson patent U.S. Pat. No. 4,478,782, the molded inserts include recesses and projections which extend from one course to the next to facilitate the precise alignment of the block wall. In order to complete a wall construction using the blocks of the Johnson patent, surface bonding is applied to the wall after the blocks have been stacked in place. The surface bonding then provides a strong integral wall. Surface bonding, however, precludes the use of split face block construction or any block construction which does not utilize a separate or subsequent finish after the wall has been constructed. Split block construction, however, is widely used, particularly in the construction of commercial buildings; so that this is a drawback to universal use of the block construction disclosed in the Johnson patent U.S. Pat. No. 4,748,782.

Concrete blocks also are somewhat difficult to handle. Conventional blocks generally are picked up by a mason by pinching the thumb and four fingers together at the center web and lifting the block using primarily the smaller forearm muscle. Since the blocks weigh approximately thirty-two pounds each, a significant muscular strain is caused by repetitive handling of the blocks.

Two patents which are directed to efforts at improving the handling characteristics of concrete blocks are the U.S. patents to Stevens U.S. Pat. No. 5,421,135 and Munsey U.S. Pat. No. 5,787,670. The Stevens patent is directed to a drystack block; and the central web is relieved from the bottom to provide a convenient handle for placing the block. The handle is oriented transversely of the longitudinal dimension of the block.

The patent to Munsey U.S. Pat. No. 5,787,670 is directed to a generally conventional building block which has an integral handhold constructed into a center transverse web. Because of the location of the opening for the handle and the configuration of the handle, this block is relatively difficult to manufacture. The block first is molded in a conventional manner. Then, while the block is still "wet", the handle opening is punched out prior to kiln drying of the block. As a consequence, the block is not particularly practical to manufacture because of the extra step required to produce it.

It is desirable to provide an improved insulated masonry building block which overcomes the disadvantages of the prior art, and which employs generally conventional masonry techniques in wall construction using the block coupled with effective insulation and ease of handling.

SUMMARY OF THE INVENTION

It is an object of this invention to provide an improved insulated masonry building block.

It is an additional object of this invention to provide an insulated masonry building block utilizing insulating foam inserts to increase overall thermal performance of the wall using such blocks, without interfering with butt or head mortar joints. It is another object of this invention to provide a masonry building block construction which facilitates ease of handling the block by the mason.

It is a further object of this invention to provide an improved insulated masonry building block capable of installation in accordance with standard masonry practices, in which non-mortar interfering insulation inserts are inserted after a course is laid and are non-mortar interfering, and which permits installation of electrical boxes and interconnecting conduit securely within the block cavities.

In accordance with a preferred embodiment of the invention, an insulated masonry building block is constructed with first, second and third spaced parallel rectangular side walls, in which the second side wall is intermediate the first and third side walls. First and second vertical end cross webs then connect the first and second side walls; and each of the first and second end cross webs have a notch in them extending a predetermined distance from the top toward the bottom. First and second spaced intermediate vertical cross webs then are located on planes between the planes of the first and second end webs to connect the second and third side walls, leaving open cavities at the ends of the second and third side walls. Each of these intermediate cross webs also have a notch therein extending from the top a predetermined distance toward the bottom.

A first insulating core is dimensioned to substantially fill the space between the first and second side walls and the first and second end cross webs; and this core has protrusions extending outwardly near the top thereof to fit into the notches in the first and second end cross webs. The first insulating core also has a longitudinal notch along the bottom thereof to eliminate mortar interference when it is inserted into a block which has been laid previously in a course during building construction.

An additional embodiment includes a second insulating core dimensioned substantially to fill the space between the first and second spaced intermediate cross webs. This second insulating core has protrusions extending outwardly from the top thereof on each side to fit into the notches in the intermediate cross webs, and also includes a vertical notch extending from the top to the bottom thereof at substantially the midpoint, along with a longitudinal notch along the bottom edge thereof. The second core also is used to fill the cavity between adjacent blocks after they are laid in a course; and the vertical notch permits non-mortar interfering insertion of the core when it bridges between adjacent blocks.

DETAILED DESCRIPTION

Figure 1:
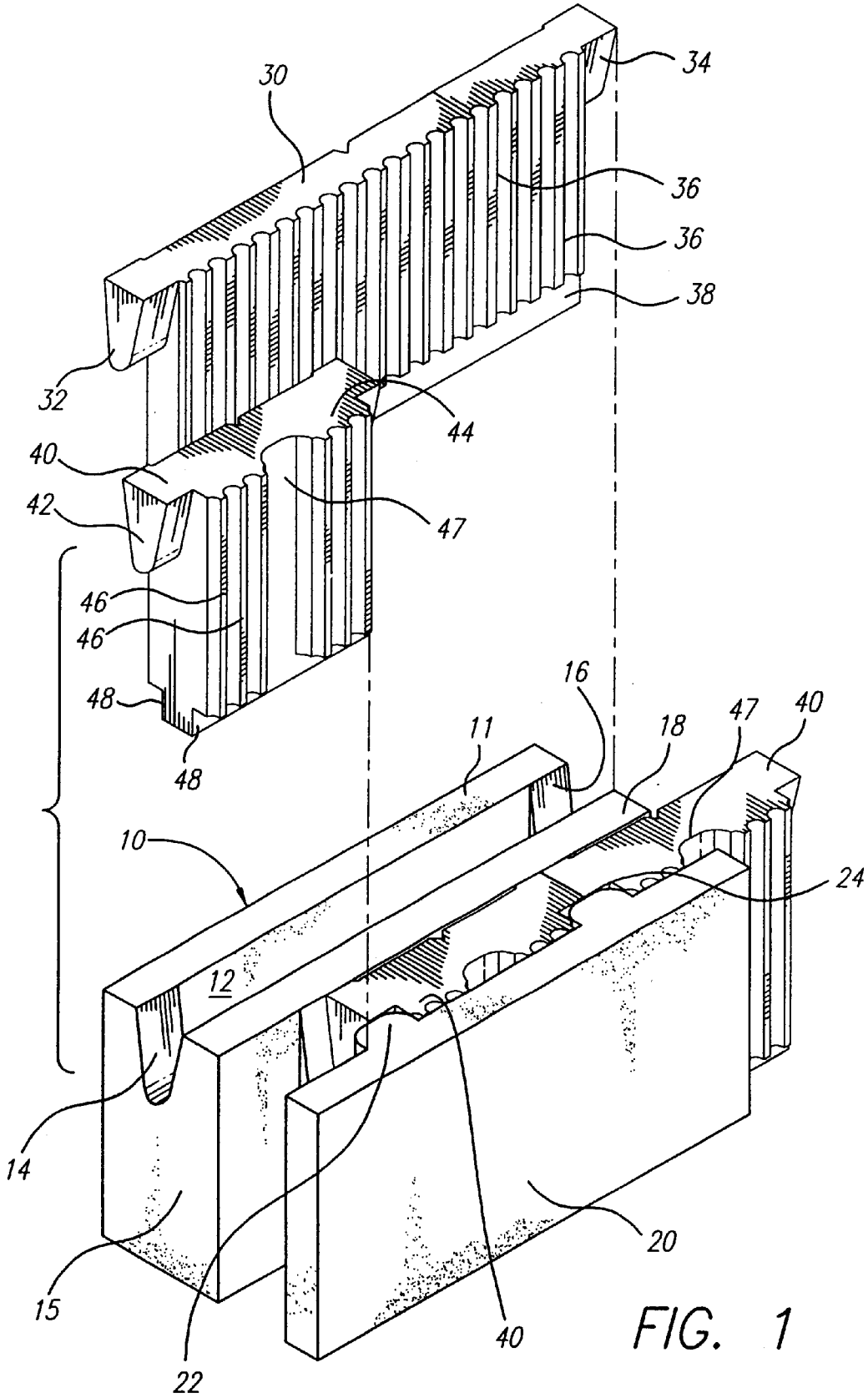
FIG. 1 is a partially exploded perspective view of a preferred embodiment of the invention.

Reference now should be made to the drawings, in which the same reference numbers are used throughout the different figures to designate the same components. FIG. 1 is an exploded front perspective view of a preferred embodiment of the invention. As shown in FIG. 1, a concrete or cementaceous building block 10 is constructed of three primary parallel side walls, 11, 18 and 20. The side walls are of equal length and have a top surface located in a first horizontal plane and a bottom surface located in a second horizontal plane. The block 10 has external dimensions which are selected to be comparable to the standard dimensions of concrete building blocks throughout the construction industry.

Figure 5:
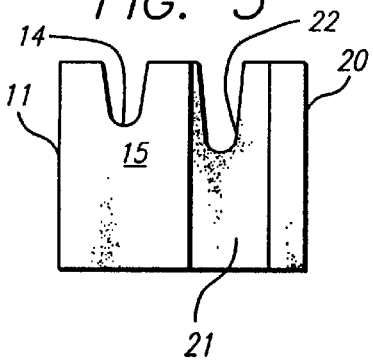
FIG. 5 is an end view taken along the line 5—5 of FIG. 2.
Figure 6:
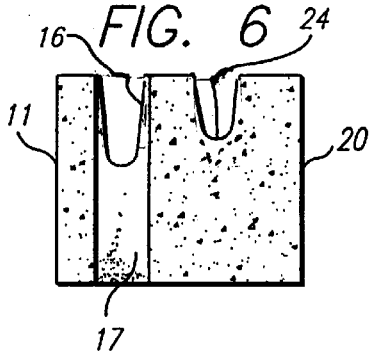
FIG. 6 is a cross-sectional view taken along the line 6—6 of FIG. 2.
Figure 7:
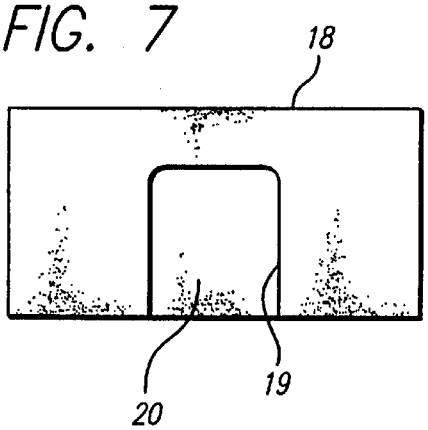
FIG. 7 is a cross-sectional view taken along the line 7—7 of FIG. 2.

The opposite ends of the side walls 11 and 18 are joined together to form a closed compartment by first and second vertical end cross webs 15 and 17. These cross webs 15 and 17 have U-shaped notches 14 and 16 located in them extending a short distance from the top of the cross webs toward the bottoms thereof. This is shown most clearly in FIGS. 1, 5 and 6.

Figure 2:
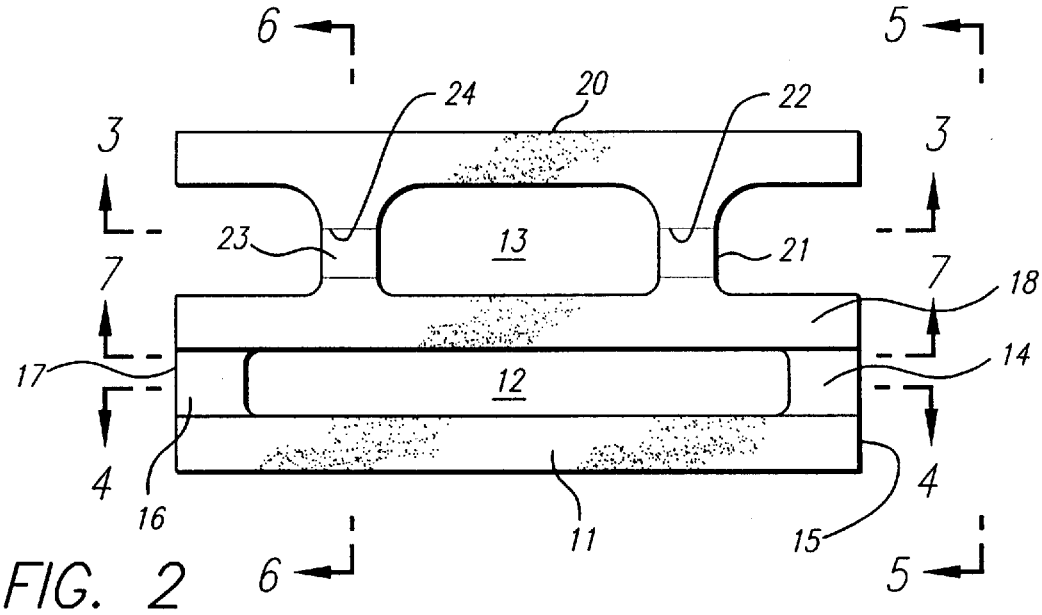
FIG. 2 is a top view of a portion of the embodiment shown in FIG. 1.

As shown most clearly in FIG. 2, intermediate cross webs 21 and 23, located in parallel planes spaced between the planes of the cross webs 15 and 17, are used to join the side walls 18 and 20 together. These intermediate cross webs also have notches 22 and 24, respectively, located in them, again as shown most clearly in FIGS. 2, 5 and 6.

The resulting structure of the block is illustrated in its various parts in FIGS. 2 through 7. From an examination of FIG. 2, it is apparent that a cavity 12 is located between the side walls 11 and 18 and the end cross webs 15 and 17. Another cavity 13 is formed between the side walls 18 and 20 and the cross webs 21 and 23. All of the side walls 11, 18 and 20 and the cross webs 15, 17, 21 and 23 have a uniform thickness or cross section from the top of the block to the bottom to provide the maximum volume for the cavities which are formed between them.

The center side wall 18 is designed with an ergonomically designed handle formed by a void or U-shaped hollow area located approximately 2½ inches from the top of the side wall 18. This is shown most clearly in FIG. 7. The area over the top of this void 19 a comfortable, easy to grip handle for manipulating the block 10 during the construction of a wall. This void of material also serves to lighten the total weight of an individual block without compromising its structural integrity. The bottom of this handle area, which is parallel to the top of the side wall 18, also may be molded with curved or rounded edges to dramatically decrease wear and abrasion on the fingers or gloves of a workman installing these blocks in a wall.

In constructing a wall with the blocks shown in FIGS. 1 through 7, standard mortar masonry practices are used to align and plumb the walls. The blocks are set in place in courses, utilizing the same techniques which are employed for standard cement building blocks in the industry. After a course of blocks has been laid, the foam inserts 30 and 40 which are shown in the exploded view of FIG. 1 are fit into the appropriate cell cavities. The elongated enclosed cell cavities 12 in each of the individual blocks are filled with an insulated core foam insert 30, as shown in FIG. 1. This foam insert is designed to be loose fitting in the cavity 12, but to further facilitate its insertion, ribs 36 are formed on one of the surfaces; so that if there is an anomaly in the interior surfaces of the side walls 11 or 18, these ribs easily are shaved down to provide a quick and simple fit of the insulating core in the cavity 12. To hold the core 30 in place, there are outwardly projecting protrusions or ears 32 and 34, on opposite sides, located near its upper surface. These projections 32 and 34 fit into the U-shaped notches 14 and 16 in the vertical end cross webs 15 and 17 to hold the insulating core 30 in place. The core 30 has a top to bottom dimension selected to cause it to be located within the cavity 12 in such a manner that it does not extend above the upper edge or upper surface of the side walls 11, 18 and 20.

It readily can be seen that when a series of the blocks 10 are laid in a course in a conventional manner, the head joints on the sides are mortar filled, as are the bottom butt joints. It is well known that standard mortar masonry practices frequently result in some excess mortar weepage along the bottom of the cavity 12 and along the edges spilling into the open-ended cavities located on the right and left-hand sides of the intermediate cross webs 21 and 23, shown in FIG. 2. To prevent a break in the mechanical bond which is provided by this mortar and to avoid disturbing the mortar, the insulation core 30 is undercut along its edges at 38, as shown in FIG. 1. Thus, the bottom of the insulating core 30 is stepped back from the side walls 11 and 18; so that no interference with the mortar weepage on the butt joints occurs. The bottom of the core 30, between the undercut portions, extends below the sidewalls 18 and 20 into the space created by the mortar in the butt joints. A second set of shorter inserts 40 then is provided to fit into the cavity 13 between the side walls 18 and 20 and the intermediate cross webs 21 and 23, again as illustrated in FIG. 1. The core inserts 40 also have vertical ribs 46 on them to accommodate any anomalies which may be present in the cavity 13 to permit easy insertion of the core inserts 40 into the cavity, as shown in FIG. 1. In addition, the center of each of the core inserts 40 has a vertical notch or groove 47 extending from the top to the bottom to space the insert 40 from the interior of the side wall 20. As with the core inserts 30, the inserts 40 also have projecting ears or tabs 42 and 44, on opposite sides, for resting in the notches 22 and 24, respectively, of the block 10. As with the core inserts 30, the inserts 40 are placed in the blocks in the manner shown in FIG. 1 after a course of blocks has been laid.

As is apparent from an examination of FIG. 1, the core inserts 40 not only are placed in the region 13 between the webs 21 and 22 of an individual block, but also bridge the space between these cross webs and the mating cross webs of the adjacent block in the manner shown in FIG. 1. When this is done, the center vertical groove 47 is located in the region of the head joints between the blocks to accommodate any mortar weepage which takes place in this area. This avoids disturbing the mortar at the head joints. As with the core inserts 30, the core inserts 40 also include an undercut or notch 48 at the bottom to accommodate mortar weepage along the butt joints at the bottoms of the blocks; and the inserts 40 extend slightly below the bottom plane of the blocks. As a consequence, no break in the mechanical bond is occasioned by insertion of the insulating cores 30 and 40 in the manner shown in FIG. 1 after a course of blocks has been laid. This unique and precise design of the foam inserts does not interfere with the mortar (wet or dry) excess areas when the inserts are placed into appropriate cell cavities in the blocks.

Figure 10:
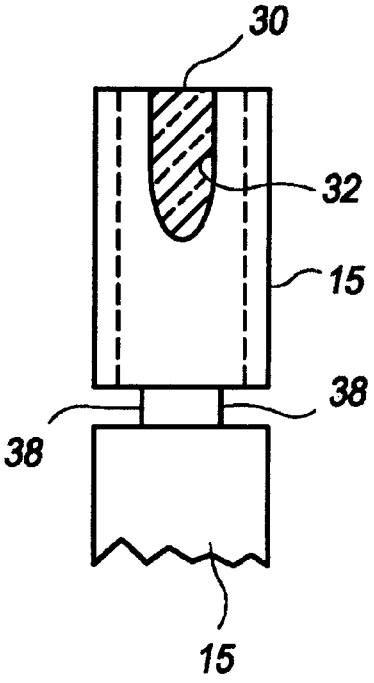
FIG. 10 is an end view of a portion of a preferred embodiment of the invention constructed into a wall.

FIG. 10 is a partially cut-away end view of the portion 15 of the block shown in FIGS. 1 and 2 illustrating the orientation of a pair of blocks 15 in vertically adjacent courses, and showing the orientation of the insulating core insert 30 when the blocks 15 are mortar set, one upon the other. The mortar has not been shown in FIG. 10 in order to clarify the drawing. As is illustrated in FIG. 10, the protrusion 32 fits into the U-shaped notch 14 to allow the upper surface of the core insert 30 to be co-planar with the top of the block. The bottom or lower edge of the core 30 rests on the top of the corresponding core 30 in the next lower course of blocks 15. The longitudinal undercut notches 38 on each side of the core 30 provide a space for mortar weepage, as is readily apparent from an examination of FIG. 10.

Figure 11:
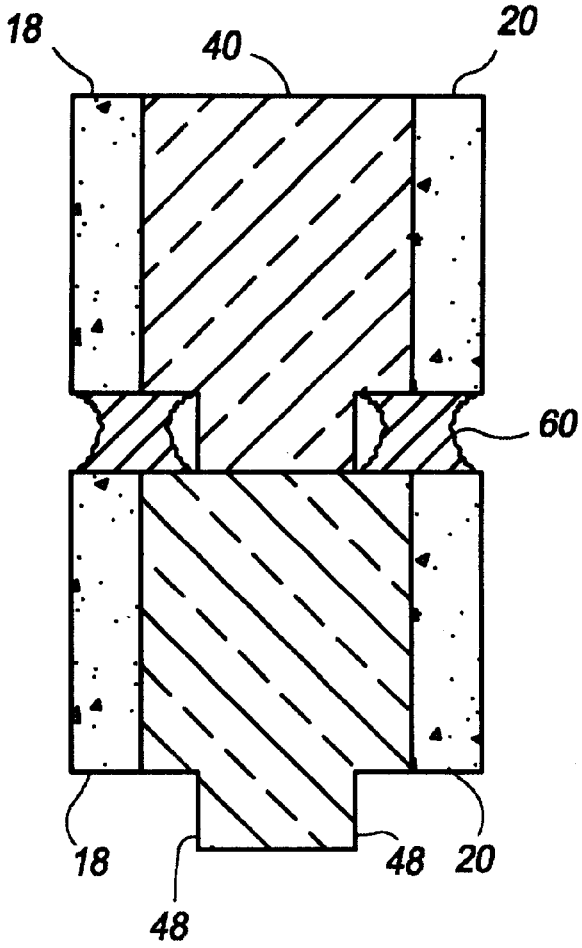
FIG. 11 is a cross-sectional view of a portion of the invention showing specific features thereof.

FIG. 11 is a cross-sectional view of a portion of the spaced-apart walls 18 and 20 of the block shown in FIGS. 1 and 2 illustrating the orientation and location of insulating cores 40 when these cores are in place in blocks of immediately adjacent upper and lower courses of blocks installed into a wall by means of a conventional mortar construction. An identical orientation and location of the insulating cores 30 also exists as shown in FIG. 10. As shown in FIG. 11, the notches 48 extend from the lower plane of the walls 18 and 20 of the upper block to the lower edge or bottom surface of the core 40 by a distance equal to the finished thickness and weepage of a mortar joint 60, as illustrated. The top edge or upper surface of the core 40 is located in the same plane as the top edges of the walls 18 and 20 of the block. The notches 48 extend longitudinally along the entire bottom edge of both sides of the cores 40, as illustrated in FIG. 11.

Since the wall thicknesses of the side walls 11, 18 and 20 and the wall thickness of the cross webs 15, 17, 21 and 23 are uniform from top to bottom (or have a slight taper from bottom to top for manufacturing purposes), a maximum volume of the cavities in the block is provided. This permits the thicknesses of the insulating core inserts 30 and 40 to be uniform (or nearly uniform) from top to bottom to permit a maximum filling of insulating material into the blocks during the construction of a wall.

As desired, various ones of the cells in the blocks may be filled with rebar and grout installation, in accordance with standard concrete block installation practices. It also is a simple matter to provide horizontal rebar in various courses of a wall by laying the rebar in the notches 14, 16 or 22, 24 and applying grout as necessary. Obviously, when this is done, those particular blocks are not provided with the insulating cores 30 and 40.

An additional improvement may be provided in the middle side wall 18 in the form of precision vertical scoring at each end of the handle formed by the undercut or void area 19. This permits a mason to lightly tap the handle with a hammer to easily remove the handle in the event that a vertical rebar protruding from either footings, stem walls or lower bond beams interferes with the handle.

Figure 9:
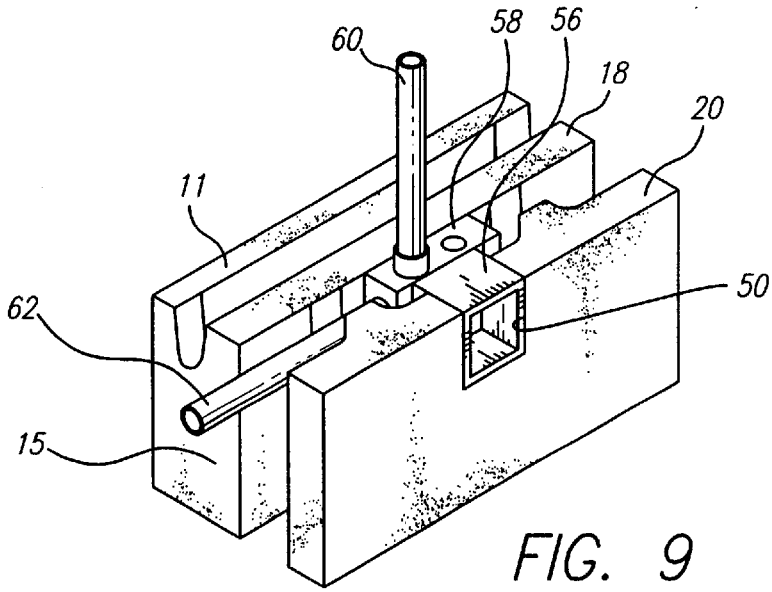
FIG. 9 is a front perspective view illustrating additional features of the embodiment shown in FIGS. 1 and 2.
Figure 3:
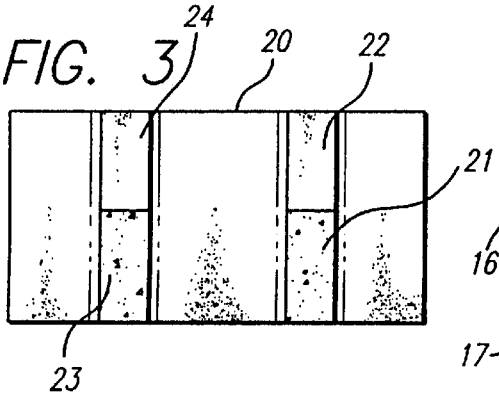
FIG. 3 is a cross-sectional view taken along the line 3—3 of FIG. 2.
Figure 4:
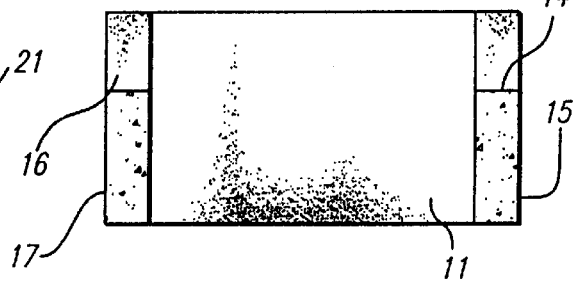
FIG. 4 is a cross-sectional view taken along the line 4—4 of FIG. 2.

As illustrated in FIG. 9, a significant advantage of the three side wall construction of the block is in the manner in which electrical box placements can be effected within the masonry wall. Standard or conventional cement masonry blocks have two deep (approximately 5") cell cavities, one on each side of a middle cross web. Typically, a mason cuts the block face where an electrical box is specified in the wall. Standard, readily available electrical box configurations are considerably less deep than the depth of these standard cavities. A, mason has no efficient method of securing an electrical box flush with the inside face of the block. There is no apparatus currently available, short of time consuming and costly masonry screws, to secure electrical boxes in place during construction when standard masonry blocks are used.

In the block which is shown in FIGS. 1 through 7 and 9, however, electrical box placement is greatly facilitated. The placement procedure identically begins with the mason cutting the block face to form a rectangular cutout 50, as shown in FIG. 9. A standard, readily available, universally manufactured electrical box 58/56 then is placed in the cutout, simply by sliding it into the cavity from the top to rest in place in the cutout box opening. The rear of the box 50 rests against the handle area of the center side wall 18 to precisely hold it in place. Again, the open cells allow for standard, readily available, universally manufactured and approved electrical conduit chases, both vertical 60 and horizontal 62 to be used without the requirement of actually installing any wiring. The conduits can be placed in the blocks in the manner shown and extend through various courses and from block-to-block within a course in the same manner as discussed previously for the installation of rebar. As a consequence, the block construction greatly facilitates subsequent electrical wiring of a building using the structures which have been shown.

Figure 8A:
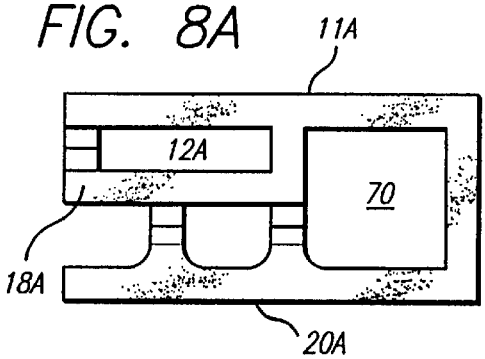
FIGS. 8A and 8B are alternative constructions of the embodiment shown in FIGS. 1 and 2.
Figure 8B:
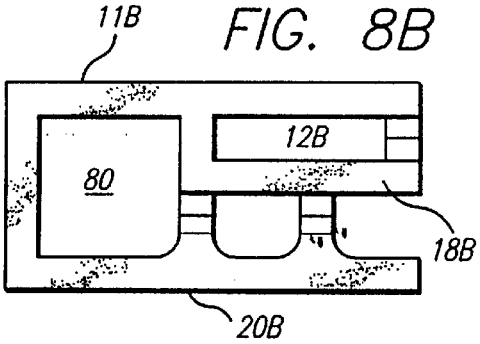

FIGS. 8A and 8B show variations of the top view of the block shown in Figure which may be used as corner or in-line pilaster blocks, which alternatively can be stacked in a running bond to provide a larger grout cell, as may be required by structural engineering. These cells 70 and 80 duplicate regular concrete block cell dimensions, and, therefore, structural capability, as well as serving as a corner block to provide a finished corner, since the block shown in FIGS. 1 through 7 has open cavities on its ends and is not satisfactory for corner construction.

Since an insulated block wall is constructed, as described above, using mortar, split face blocks may be used, as well as blocks requiring a separate finish. This provides complete design flexibility for the builder.

The foregoing description of the preferred embodiment of the invention is to be considered as illustrative and not as limiting. Various other changes and modifications will occur to those skilled in the art for performing substantially the same function, in substantially the same way, to achieve substantially the same result without departing from the true scope of the invention as defined in the appended claims.

What is claimed is:

1. An insulated masonry building block for use in a mortar set masonry wall comprising:

first, second and third spaced, parallel, rectangular side walls, with said second side wall located intermediate said first and third side walls, wherein said first, second and third rectangular side walls each have a bottom edge located in a first horizontal plane and said first, second and third rectangular side walls each have a top edge located in a second horizontal plane;

first and second vertical end cross webs connecting the ends of said first and second side walls in first and second respective planes, each of said first and second end cross webs having a notch therein extending a predetermined distance from the top thereof toward the bottom thereof;

first and second spaced intermediate vertical cross webs located on spaced planes between the first and second planes of said first and second end cross webs and connecting said second and third side walls, said intermediate cross webs each having a notch therein extending from the top thereof a predetermined distance toward the bottom thereof;

a first insulating core dimensioned to substantially fill the space between said first and second side walls and said first and second end cross webs, said first insulating core having top and bottom edges, with end protrusions extending outwardly at the top edge thereof to fit into the notches in said first and second end cross webs, and with a longitudinal notch along the entire bottom edge of said first insulating core wherein the bottom edge of said first insulating core extends outwardly beyond said first horizontal plane, the longitudinal notch in the first insulating core is located between the first horizontal plane and the bottom edge of the first insulating core, for receiving mortar therein and the top edge of said first insulating core does not extend beyond said second horizontal plane such that the extended bottom edge of the insulating core of the upper block abuts the edge of the insulating core of the lower block to eliminate mortar interference, when said blocks are incorporated into a mortar set masonry wall.

2. The building block according to claim 1 comprising a second insulating core dimensioned substantially to fill the space between the first and second spaced intermediate cross webs, said second insulating core having top and bottom edges, with end protrusions extending outwardly at the top thereof on each side to fit into the notches in said first and second intermediate cross webs, with a vertical notch therein extending from the top to bottom thereof at substantially the mid point thereof, and with a longitudinal notch therein along the entire bottom edge thereof, wherein the bottom edge of said second insulating core extends beyond said first horizontal plane, the longitudinal notch in said second insulating core is located between the first horizontal plane and the bottom edge of said second insulating core and the top edge of said insulating core does not extend beyond said second horizontal plane said vertical and longitudinal notches in the second insulating core designed to eliminate mortar interference by said second insulating core when said block is incorporated into a masonry wall.

3. The insulated block according to claim 2 wherein said first and second spaced intermediate vertical cross webs are spaced apart a distance which is, substantially one-half the overall length of said first, second and third side walls, and said first and, second spaced intermediate cross webs are located to cause the space between them to be substantially centered between the ends of said second and third sidewalls.

4. The building block according to claim 3 wherein said first and second spaced intermediate vertical cross webs are spaced apart a distance which is substantially half the length of said first, second and third sidewalls, with said first intermediate cross web located inwardly from a first end of said second and third side walls a distance approximately one-fourth of the overall length of said first and second side walls.

5. The building block of claim 4 wherein said first, second and third rectangular side walls, said first and second vertical end cross webs, and said first and second intermediate vertical cross webs are formed from concrete.

6. The building block according to claim 5 wherein the protrusions extending outwardly at the top of said second insulating core extend substantially half way across the notches in said first and second intermediate cross webs.

7. The building block according to claim 6 wherein the notches in said first and second vertical cross webs and in said first and second spaced intermediate cross webs have a generally U-shaped configuration.

8. The building block of claim 7 wherein said first, second and third rectangular side walls, said first and second vertical end cross webs, and said first and second spaced intermediate vertical cross webs each have a substantially uniform thickness from the top thereof to the bottom thereof.

9. The building block according to claim 1 wherein said first, second and third rectangular side walls each have a substantially constant wall thickness from the top to the bottom thereof.

10. The building block according to claim 9 wherein said first and second end webs and said first and second intermediate cross webs each have a substantially uniform thickness from the top to the bottoms thereof.

11. The building block according to claim 10 comprising a second insulating core dimensioned substantially to fill the space between the first and second spaced intermediate cross webs, said second insulating core having top and bottom edges, with end protrusions extending outwardly at the top thereof on each side to fit into the notches in said first and second intermediate cross webs, with a vertical notch therein extending from the top to bottom thereof at substantially the mid point thereof, and with a longitudinal notch therein along the entire bottom edge thereof, wherein the bottom edge of said second insulating core extends beyond said first horizontal plane, said longitudinal notch in said second insulating core is located between said first horizontal plane and the bottom edge of said second insulating core and the top edge of said second insulating does not extend beyond said second horizontal plane, said vertical and longitudinal notches designed to eliminate mortar interference when said block is incorporated into a masonry wall.

12. The building block according to claim 1 wherein the notches in said first and second vertical cross webs and in said first and second spaced intermediate cross webs have a generally U-shaped configuration.

13. The insulated block according to claim 1 wherein said first and second spaced intermediate vertical cross webs are spaced apart a distance which is substantially one-half the overall length of said first, second and third side walls, and said first and second spaced intermediate cross webs are located to cause the space between them to be substantially centered between the ends of said second and third sidewalls.

14. The building block according to claim 13 comprising a second insulating core dimensioned substantially to fill the space between the first and second spaced intermediate cross webs, said second insulating core having top and bottom edges, with end protrusions extending outwardly at the top thereof on each side to fit into the notches in said first and second intermediate cross webs, with a vertical notch therein extending from the top to bottom thereof at substantially the mid point thereof, and with a longitudinal notch therein along the entire bottom edge thereof, wherein the bottom edge of said second insulating core extends beyond said first horizontal plane, said longitudinal notch in said second insulating core is located between said first horizontal plane and the bottom edge of said second insulating core and the top edge of said second insulating does not extend beyond said second horizontal plane, said vertical and longitudinal notches designed to eliminate mortar interference when said block is incorporated into a masonry wall.

15. The building block according to claim 14 wherein the protrusions extending outwardly at the top of said second insulating core extend substantially half way across the notches in said first and second intermediate cross webs.

16. The building block according to claim 1 wherein said second side wall has a U-shaped open area therein extending upwardly from the bottom thereof to form a handle.

17. For use in conjunction with building blocks for a mortar set masonry wall, where the building blocks each have at least first and second spaced-apart side walls located in substantially parallel spaced planes, and interconnected by at least one cross web to maintain,the spacing thereof the side walls each having a bottom edge located in a first horizontal plane and each having a top edge located in a second horizontal plane to form at least one space with a predetermined width between the first and second side walls, an insulating insert including in combination:

an insulating core having first and second longitudinal sides, a top surface, and a bottom surface dimensioned to substantially fill the space between the first and second side walls, with the first and second longitudinal sides thereof located, respectively, adjacent the first and second side walls of a building block and designed to be placed in the space, between the first and second side walls of the block after the block has been laid in a mortar set wall, the top surface of the insulating core being substantially co-planar with the second horizontal plane of the building block and the bottom surface extending below the first horizontal plane of the building block by an amount adapted to be equal to the mortar thickness between adjacent courses of building blocks in a mortar set wall, the insulating core having at least one longitudinal notch along the entire bottom surface and one of the first and second longitudinal sides, thereof extending from the first horizontal plane to the bottom surface of the insulating core to eliminate mortar interference by the insulating core for receiving mortar therein, and the extended bottom surface of the insulating core of the upper block eliminating mortar interference between blocks when the insulating core is inserted into the space between the first and second side walls of the block after the block has been set in place.

18. An insulating insert according to claim 17 where the insulating core has longitudinal notches along the bottom surfaces and both of the first and second sides and extending from the first horizontal plane to the bottom of the insulating core when the insulating core is placed in a building block in a masonry set wall.

19. An insulating insert according to claim 17 wherein the insulating core is made of insulating foam material.

20. An insulating insert according to claim 17 wherein the insulating core further has a vertical notch located therein between the top surface thereof and the longitudinal notch, with the vertical notch located at substantially the midpoint of the insulating core.

21. An insulating insert according to claim 17 wherein the dimensions of the insulating core are designed to substantially fill the space between the first and second side walls of the building block for forming a removable slip-fit therebetween.

* * * * *